United States Patent [19]

Verable et al.

[11] 4,296,575

[45] Oct. 27, 1981

[54] AUTOMOBILE SHED

[76] Inventors: Diara Verable, 3803 Groton St., San Diego, Calif. 92110; Willie M. Gibson, both of San Diego, Calif. 92110

[21] Appl. No.: 106,911

[22] Filed: Dec. 26, 1979

[51] Int. Cl.[3] ..... E04B 7/16

[52] U.S. Cl. ..... 52/66

[58] Field of Search ..... 52/66, 143, 64; 49/386

[56] References Cited

U.S. PATENT DOCUMENTS

| | | | |
|---|---|---|---|
| 674,678 | 5/1901 | Geran | 49/386 |
| 1,975,701 | 10/1934 | Poos | 49/386 |
| 2,742,674 | 4/1956 | Melder | 52/64 |
| 3,258,886 | 7/1966 | Button | 52/66 |
| 3,367,073 | 2/1968 | Seeger | 52/66 |

FOREIGN PATENT DOCUMENTS

| | | | |
|---|---|---|---|
| 846458 | 8/1952 | Fed. Rep. of Germany | 52/66 |

*Primary Examiner*—Price C. Faw, Jr.
*Assistant Examiner*—Henry E. Raduazo
*Attorney, Agent, or Firm*—Ralph S. Branscomb

[57] ABSTRACT

A shed is provided principally for the storage of a unitary automobile and includes a frame bolted to the ground or a cement slab, and an overlying housing substantially conforming to the external shape of the vehicle, the housing being hinged to the frame and spring-loaded such that access to the vehicle is provided by lifting the entire housing clear of the stored automobile.

1 Claim, 9 Drawing Figures

AUTOMOBILE SHED

BACKGROUND

Protection of automobiles from the elements as well as vandals and thieves is problematic to one not having a garage, and even regarding houses having garages it is inefficient to waste an entire oversized room which the garage represents on the storage of a vehicle.

The alternatives to a garage are few. Some people use covers of canvas or the like contoured to fit the body of the automobile to cover the vehicle when not in use. This technique to a certain extent protects the surface of the vehicle from the weather, and inhibits thieves, but is not a good barrier against theivery or vandalism. Erection of a carport, being much simpler than a garage, also only serves to partially protect the vehicle.

There is thus the need for a simple structure which conforms to the absolute minimum structure to absolutely protect an automobile from all manner of abuse and burglary when parked.

SUMMARY

The present invention fulfils the above-stated need and provides a housing conforming fairly closely to the contours of an automobile, so that extra weight and expense is not added to this housing. The housing is hinged at it lower rear edge to a frame which is mounted directly to the ground or a concrete slab. The housing is counter-balanced and can be raised in its entirety on its hinge clear of a stored automobile, the counter-balance mechanism being sufficient to hold the housing in its elevated position while the car is driven out. Being in the nature of a shed rather than a garage, naturally the construction need not be to the standards set in building codes, nor is it nearly the size of a garage, so that essentially the same degree of protection of a full sized garage is afforded by means of an inexpensive, light-weight, and reasonably portable structure.

DETAILED DESCRIPTION OF THE PREFERRED EMBODIMENT

Figure 1:
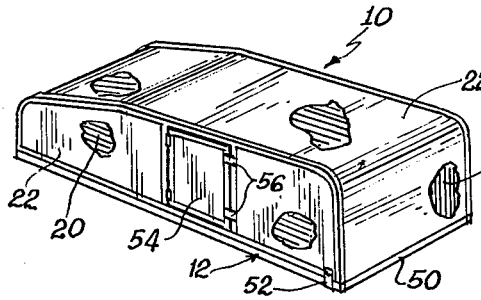
FIG. 1 is a perspective view of the shed in its lowered position.
Figure 2:
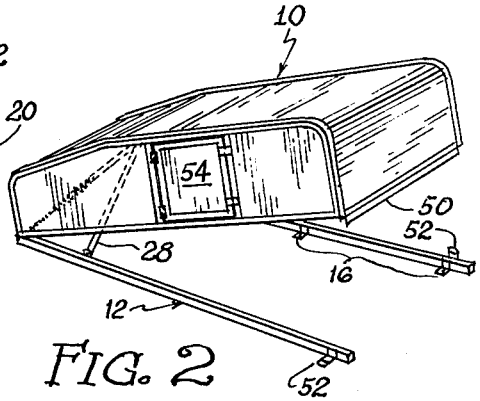
FIG. 2 is a perspective view of the shed in its raised position.
Figure 3:
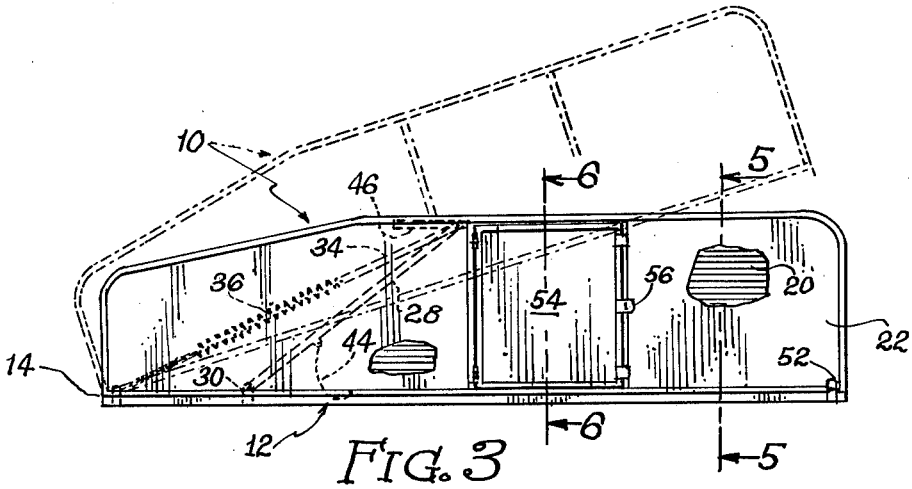
FIG. 3 is a side elevation view of the shed in its lowered position showing the elevated position in phantom and revealing the counter-balance.
Figure 4:
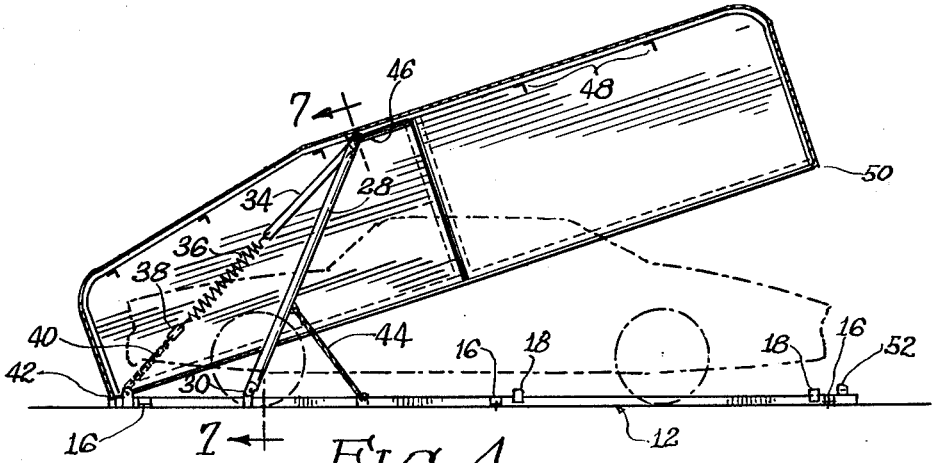
FIG. 4 is a sectional view of the shed in raised position with an automobile thereunder
Figure 5:
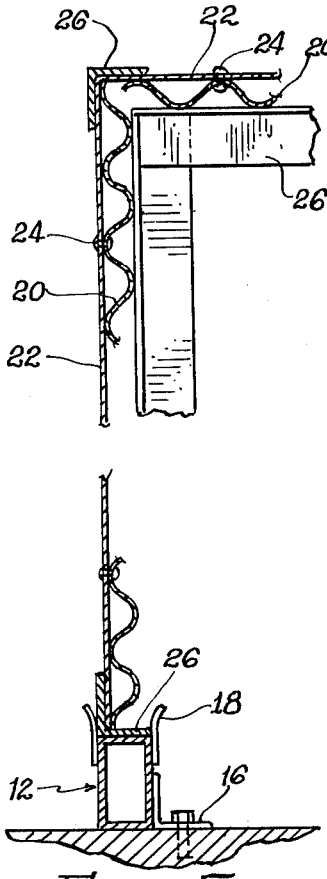
FIG. 5 is a section along line 5—5 of FIG. 3.
Figure 6:
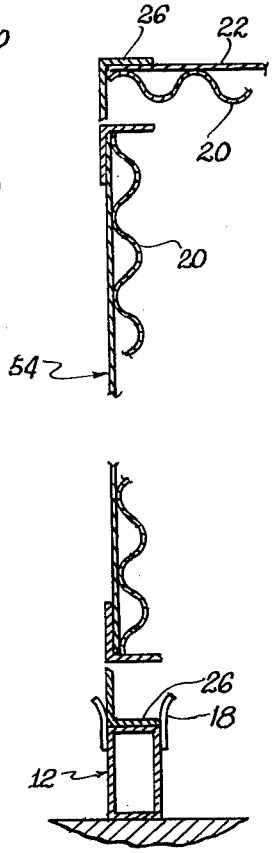
FIG. 6 is a section taken along line 6—6 of FIG. 3.
Figure 7:
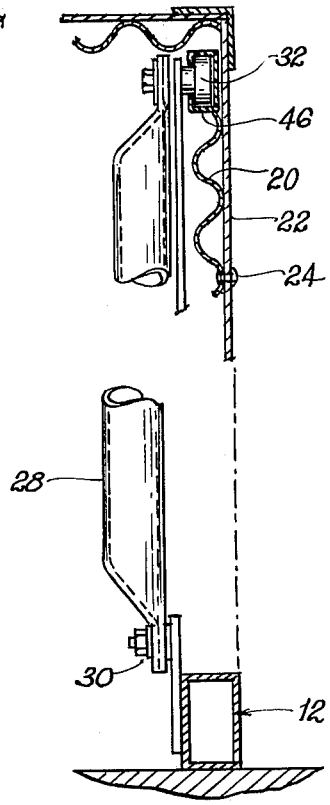
FIG. 7 is a section taken along line 7—7 of FIG. 4.
Figure 8:
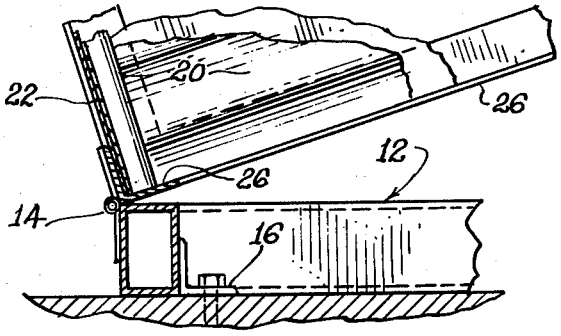
FIG. 8 is a section taken through a detail of the structure including the hinge.
Figure 9:
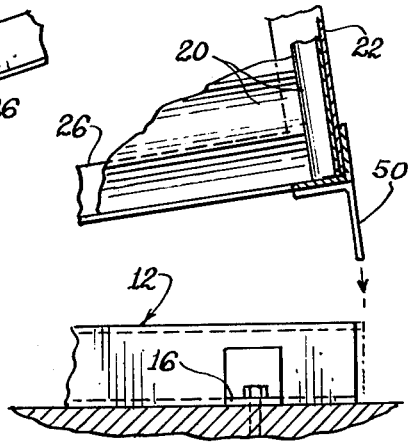
FIG. 9 is a section taken through the front edge of the housing and revealing the frame in side elevation.

As is best seen in FIGS. 1-4, the invention includes two basic parts, an upper housing 10 and a lower frame 12, to which the housing is hinged at 14. The housing, frame and hinge define all that is really necessary for a functioning unit which simply constitutes a housing raisable to admit an automobile.

The frame in the preferred embodiment is a generally U-, shaped member open to the front and bolted to the underlying ground or concrete slab at the positions indicated by the bolted flanges 16. It should be noted that some or all of these flanges are interiorly directed to prevent unbolting or removing or removing the shed from the exterior, providing access to the vehicle. The frame 12 could be of rectangular tubular construction as shown, and preferably utilyzes spaced seating or guide members 18 to ensure proper seating of the housing on the frame.

The housing may be of any light-weight, strong construction and as indicated utilyzes in its polanar portions corrugated sheet metal 20 exteriorly surfaced with plastic panel material 22 maintained thereon with rivets 24. Angle irons 26 finish the edges of the housing to define a strong, exteriorly smoothe unit.

Some counter-balancing means is desireable both for aiding the lifting of the housing and for maintaining it in its raised position once it has arrived. The means shown is exemplary and could be supplanted by alternative mechanical equivalents. In the illustrated embodiment a long rigid strut 28 is pivoted at its bottom to the frame 12 at 30 and at its top defines a track-engaging member such as roller 32. Also connected to the roller is a flat link bar 34 connecting to an extension spring 36, a turnbuckle 38 and a chain 40m which is in turn connected at 42. The turnbuckle of course provides a tension adjustment for the spring, and as can best be seen in FIG. 4, as the housing is lifted, the angle between the spring and the strut increases, providing a somewhat greater lifting force on the housing which is also augmented by the fact the center of gravity is moved closer to the center of ground support. Thus in its uppermost position, which is defined by cable restrainer 44, the spring mechanism just described holds the housing in its raised position. Because of the geometry of this arrangement a track 46 is provided along the upper edge of the housing and sliably engages the roller 32.

Other features of the invention include reinforcing crossbars 48, weatherseal lip 50 across the front edge of the unit, hasp 52 for locking the housing to the frame, and an auxilliary door 54 having its own hasp 56. The auxilliary door can be used either to provide access to the door of the vehicle in the instance, for example, when one leaves his keys in the car and doesn't want to raise the entire structure to them, or alternatively if the shed is desired to be used for general storage other than for a vehicle. Even when used for general storage, the shed has distinct advantages over a traditional shed in that objects too large or cumbersome to fit through the small door can be stored by raising the upper housing on its hinge.

As thus described and claimed, the invention represents a clear advance in vehicle storage systems, and provides a means of positively preventing access by burglars, vandals, and the elements to a motor vehicle without the usual requisite of an expensive garage with its incumbent stringent requirements vis-a-vis local building codes. Within the general limitations of a base or frame permanently secured to the ground and a lockable hinged upper housing pivoted to the frame, modifications of the different structural parts and functional features of the shed within the scope of the appended claims defined below are expressly incorporated as claimed subject matter.

I claim:

1. A liftable vehicle storage shed comprising:

(a) a horseshoe-shaped box-beam frame having two legs and a rear cross member;

(b) a substantially flattened housing conforming generally to the exterior shape of a vehicle and hinged to said frame crossbeam to fall flush against said horseshoe-shaped frame when in lowered position to define an enclosed space over the surface on which it rests, said housing being pivotal on said crossbeam from said lowered position to a raised position providing access therewithin;

(c) said box-beam being bolted down to a flat driving surface by inwardly directed L-shaped flanges to prevent tampering with mounting bolts in said flanges when said housing is lowered, and said box beam also mounting upwardly directed parallel guide members to guide the periphery of said housing into seated position;

(d) an access door positioned to substantially align with a vehicle stowed in said shed;

(e) means for maintaining said housing in raised position comprising a rigid strut pivoted at the lower end thereof at a first point on said frame and defining a tracking member at its upper end, and further including an adjustable extension spring means connected between an upper portion of said strut and a point on said frame reward of said first point, and said housing defines a longitudinal track slideable engaging said tracking member; and (f) a tether connected between said housing and said frame to limit the extent of opening of said housing.

* * * * *